US010368171B2

(12) United States Patent
Yoo et al.

(10) Patent No.: US 10,368,171 B2
(45) Date of Patent: Jul. 30, 2019

(54) AUDIO APPARATUS AND AUDIO OUTPUT PORT

(71) Applicant: Radsone Inc., Sungnam (KR)

(72) Inventors: Chul-Jae Yoo, Sungnam (KR); Woo Suk Lee, Seoul (KR)

(73) Assignee: RADSONE INC., Sungnam (KR)

( * ) Notice: Subject to any disclaimer, the term of this patent is extended or adjusted under 35 U.S.C. 154(b) by 25 days.

(21) Appl. No.: 15/634,245

(22) Filed: Jun. 27, 2017

(65) Prior Publication Data

US 2017/0374467 A1 Dec. 28, 2017

(30) Foreign Application Priority Data

Jun. 28, 2016 (KR) ..... 10-2016-0080659

(51) Int. Cl.
*H04R 5/04* (2006.01)
*H01R 24/58* (2011.01)

(52) U.S. Cl.
CPC ..... *H04R 5/04* (2013.01); *H01R 24/58* (2013.01); *H04R 2420/05* (2013.01); *H04R 2499/11* (2013.01)

(58) Field of Classification Search
CPC ..... H04R 5/04
See application file for complete search history.

(56) References Cited

U.S. PATENT DOCUMENTS

2002/0101999 A1* 8/2002 Tsai ..... H04R 5/033 381/1
2016/0373861 A1* 12/2016 Poulsen ..... H01R 24/58
2017/0026752 A1* 1/2017 Jung ..... H04R 5/04

* cited by examiner

*Primary Examiner* — Joseph Saunders, Jr.
(74) *Attorney, Agent, or Firm* — Morgan, Lewis & Bockius LLP

(57) ABSTRACT

An audio apparatus includes an analog module that receives a digital left (L) channel signal and a digital right (R) channel signal and outputs first and second analog L signals and first and second analog R signals, a first output port that includes first to fifth conductors, through which the first and second analog L signals, the first and second analog R signals, and a ground voltage are provided, and a second output port that includes sixth to ninth conductors, through which the first and second analog L signals and the first and second analog R signals are provided. When an audio jack including first to third terminals is inserted into the first output port, the first and second conductors are connected to the first terminal, the third and fourth conductors are connected to the second terminal, and the fifth conductor is connected to the third terminal.

4 Claims, 5 Drawing Sheets

AUDIO APPARATUS AND AUDIO OUTPUT PORT

RELATED APPLICATION

This application claims priority to, and the benefit of, Korean Patent Application No. 10-2016-0080659, filed on Jun. 28, 2016, which is incorporated by reference herein in its entirety.

TECHNICAL FIELD

This application relates to an audio apparatus and an audio output port.

BACKGROUND

Conventional audio apparatus have only one output port. An audio jack (e.g., an audio plug) configured for receiving a single-ended signal is inserted into the output port (e.g., an audio socket). The audio jack typically has three terminals, and the three terminals receive, through the output port, a single-ended left (L) signal, a single-ended right (R) signal, and a ground voltage, respectively.

Recently, audio apparatuses with additional output ports have been made due to various demands of consumers. For example, an audio jack for receiving a differential signal has four terminals. The four terminals receive differential L signals and differential R signals through an output port.

SUMMARY

This application describes an audio apparatus that includes (a-i) an output port for outputting a single-ended signal and (a-ii) an output port for outputting a differential signal.

This application also describes providing an audio apparatus that removes some or all analog switches located between an amplifier and an output port, thereby improving sound quality. Sound quality degradation caused by the analog switches (e.g., resistance thereof) is reduced or eliminated.

This application further describes providing an audio apparatus configured to increase driving current for an audio jack configured for receiving single-ended signals, thereby improving sound quality.

According to some embodiments, an audio apparatus includes: (b-i) an analog module that is configured to receive a digital left (L) channel signal and a digital right (R) channel signal, and output first and second analog L signals and first and second analog R signals; (b-ii) a first output port including first to fifth conductors configured to provide the first and second analog L signals, the first and second analog R signals, and a ground voltage, respectively; and (b-iii) a second output port including sixth to ninth conductors configured to provide the first and second analog L signals and the first and second analog R signals, respectively. While an audio jack including first to third terminals is inserted into the first output port, the first and second conductors are connected to the first terminal, the third and fourth conductors are connected to the second terminal, and the fifth conductor is connected to the third terminal.

According to some embodiments, an audio output port is configured to receive an insertion of an audio jack including first to third terminals. The audio output port includes: (c-i) a first conductor configured to connect to the first terminal while the audio jack remains inserted in the audio output port; (c-ii) a second conductor configured to connect to the first terminal while the audio jack remains inserted in the audio output port; (c-iii) a third conductor configured to connect to the second terminal while the audio jack remains inserted in the audio output port; (c-iv) a fourth conductor configured to connect to the second terminal while the audio jack remains inserted in the audio output port; and (c-v) a fifth conductor configured to connect to the third terminal while the audio jack remains inserted in the audio output port.

According to some embodiments, an audio apparatus includes: (d-i) a first output port configured to receive insertion of a first audio jack configured for receiving a single-ended L signal, a single-ended R signal, and a ground voltage; (d-ii) a second output configured to receive insertion of a second audio jack configured for receiving first and second differential L signals and first and second differential R signals; (d-iii) a control unit configured to generate a control signal in accordance with at least one of whether the first audio jack is inserted into the first output port and whether the second audio jack is inserted into the second output port; and (d-iv) an analog module configured to output signals selected in accordance with the control signal from differential analog L signals and two single-ended analog L signals by digital-analog converting and amplifying a digital L channel signal, and outputs signals selected in accordance with the control signal from differential analog R signals and two single-ended analog R signals by digital-analog converting and amplifying a digital R channel signal.

BRIEF DESCRIPTION OF THE DRAWINGS

Exemplary embodiments are described herein with reference to the following drawings. The following drawings are not intended to limit the scope of claims, and are presented as examples. Like reference numerals refer to corresponding parts throughout the figures.

DETAILED DESCRIPTION

Figure 1:
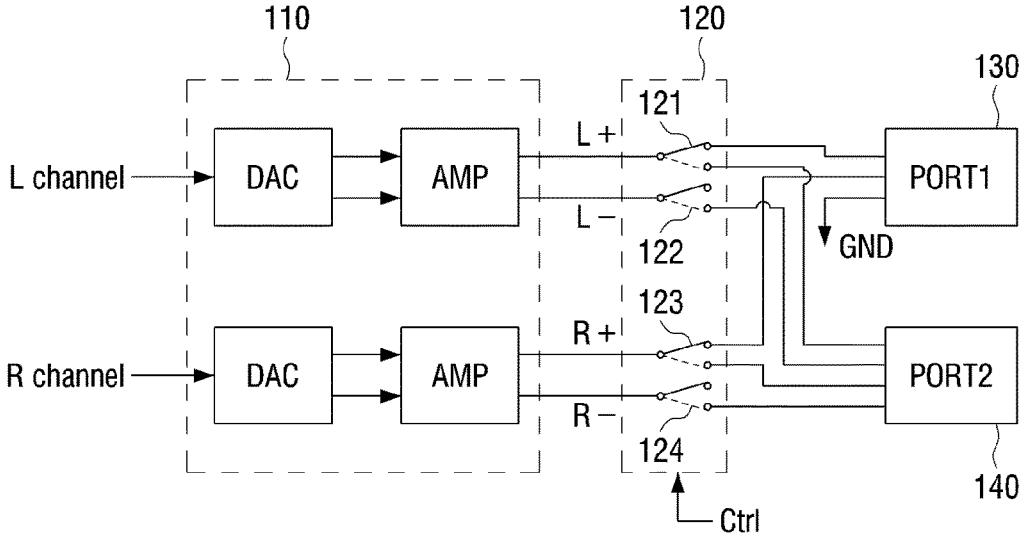
FIG. 1 is a view showing an example audio apparatus.

Specific embodiments thereof are shown by way of example in the drawings and will herein be described in detail. However, it should be understood that there is no intent to limit the invention to the particular forms disclosed and, on the contrary, the claims are intended to cover all modifications, equivalents, and alternatives of the embodiments described herein.

It should be understood that, although the terms first, second, A, B, etc. are be used herein to describe various elements, these elements are not limited by these terms. These terms are only used to distinguish one element from another. For example, a first output port could be termed a second output port, and similarly, a second output port could be termed a first output port. The first output port and the second output port are output ports, but the first output port is not the same output port as the second output port.

As used herein, the term "and/or" includes any and all combinations of one or more of the associated listed items.

As used herein, the singular forms "a," "an," and "the" are intended to include the plural forms as well unless clearly indicated otherwise in context. It should be further understood that the terms "includes," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

The elements shown in the drawings and the description thereof are used to describe representative functions of such elements. That is, two or more elements can be joined as one element, or one element can be divided into two or more elements. Moreover, each element described below can perform not only its own representative function but also part or all of the functions of other elements. In addition, it is also possible that a part of the representative function pertaining to a particular element can be fully performed by other elements.

In description of methods and operations, the described steps may be performed in an order different from the order of description, unless a specific order of steps is explicitly stated herein. That is, the described steps can be performed in the order of description, can be performed substantially simultaneously, and/or can also be performed in a reverse order.

FIG. 1 is a view showing an example audio apparatus. In FIG. 1, the audio apparatus includes an analog module 110, an analog switch 120, a first output port 130, and a second output port 140.

The analog module 110 outputs differential left (L) signals L+ and L− and differential right (R) signals R+ and R− obtained by digital-analog converting and optionally amplifying digital L channel signals and digital R channel signals. The analog switch 120 transmits the differential L signals L+ and L− and the differential R signals R+ and R− to an output port selected among first and second output ports 130 and 140 according to a control signal Ctrl. When the control signal Ctrl indicates providing an audio output to the first output port 130, switches 121 to 124 are connected as indicated by solid lines in FIG. 1. Accordingly, the positive differential L signal L+ and the positive differential R signal R+ are connected to the first output port 130. When the control signal Ctrl indicates providing an audio output to the second output port 140, the switches 121 to 124 are connected as indicated by dotted lines in FIG. 1. Accordingly, the different L signals L+ and L− and the differential R signals R+ and R− are connected to the second output port 140.

The audio apparatus shown in FIG. 1 has the following problems. First, the analog switch 120 may be implemented with a complementary metal-oxide semiconductor (CMOS) switch or the like, which increases resistance (e.g., increases resistance of the pathway). The increased resistance degrades quality of audio signals provided to a headphone or an earphone connected to the output port 130 or 140. Second, when the control signal Ctrl indicates providing the audio output to the second output port 140, the outputs L+, L−, R+, and R− of the analog module 110 are all connected to the second output port 140 so that they can be all utilized, but when the control signal Ctrl indicates providing the audio output to the first output port 130, only the positive outputs L+ and R+ of the outputs L+, L−, R+, and R− of the analog module 110 are connected to the first output port 130 so that the remaining outputs L− and R− are not utilized. This reduces circuit or power efficiency.

Figure 2:
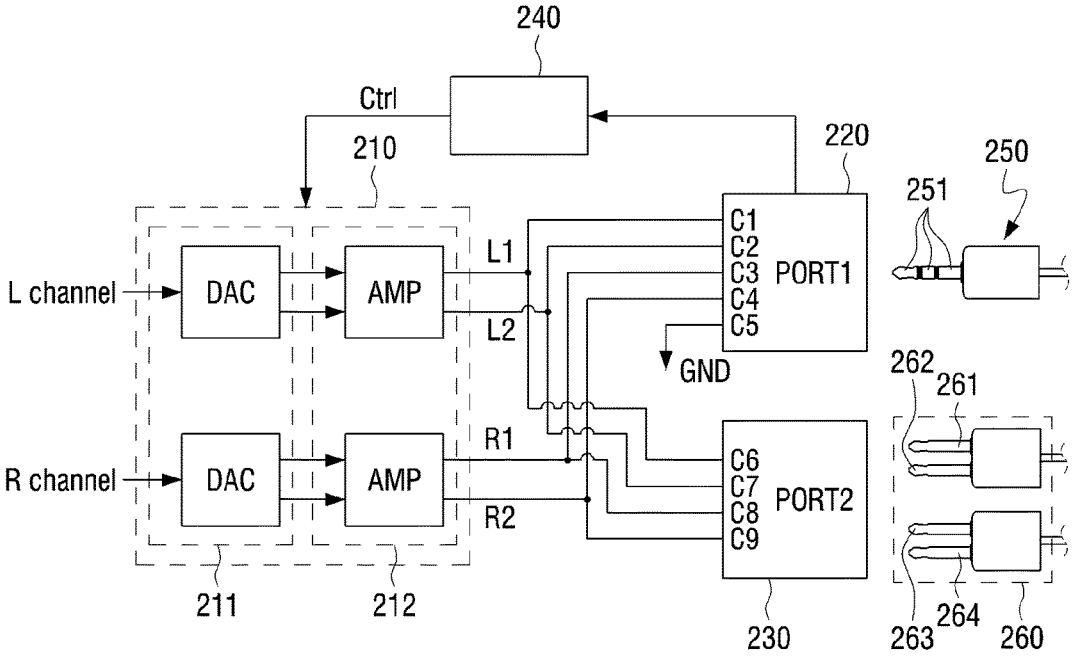
FIG. 2 is a view showing an audio apparatus according to some embodiments.

FIG. 2 is a view showing an audio apparatus according to some embodiments. In FIG. 2, the audio apparatus includes an analog module 210, a first output port 220, a second output port 230, and a control unit 240.

An analog module 210 receives a digital L channel signal and a digital R channel signal, and outputs first and second analog L signals L1 and L2 and first and second analog R signals R1 and R2. The analog module 210 outputs the first and second analog L signals L1 and L2 obtained by digital-analog converting the digital L channel signal and optionally amplifying the analog converted L channel signal, and outputs the first and second analog R signals R1 and R2 obtained by digital-analog converting the digital R channel signal and optionally amplifying the analog converted R channel signal.

The analog module 210 operates in a differential mode or a single-ended mode according to a control signal Ctrl. While the analog module 210 operates in the differential mode, the analog module 210 outputs the first and second analog L signals L1 and L2 operating in the differential mode and the first and second analog R signals R1 and R2 operating in the differential mode. Any one of the first and second analog L signals L1 and L2 operating in the differential mode corresponds to a positive L signal, and the remaining one corresponds to a negative L signal with the opposite polarity to the positive L signal (e.g., L1 corresponds to a positive L signal and L2 corresponds to a negative L signal, or L1 corresponds to the negative L signal and L2 corresponds to the positive L signal). Any one of the first and second analog R signals R1 and R2 operating in the differential mode corresponds to a positive R signal, and the remaining one corresponds to a negative R signal with the opposite polarity to the positive R signal (e.g., R1 corresponds to a positive R signal and R2 corresponds to a negative R signal, or R1 corresponds to the negative R signal and R2 corresponds to the positive R signal). While the analog module 210 operates in the single-ended mode, the analog module 210 outputs the first and second analog L signals L1 and L2 operating in the single-ended mode and the first and second analog R signals R1 and R2 operating in the single-ended mode. The first and second analog L signals L1 and L2 operating in the single-ended mode correspond to single-ended L signals with the same polarity (e.g., both L1 and L2 correspond to L). The first and second analog R signals R1 and R2 operating in the single-ended mode correspond to single-ended R signals with the same polarity (e.g., both R1 and R2 correspond to R).

The analog module 210 includes a digital-analog converter 211 and optionally, an amplifier 212. The digital-analog converter 211 performs digital-analog conversion on the digital L channel signal and the digital R channel signal. The amplifier 212 outputs the first and second analog L signals L1 and L2 and the first and second analog R signals R1 and R2 obtained by amplifying the output of the digital-analog converter 211. In some embodiments, the analog module 210 includes two digital-analog converters 211 and optionally, two amplifiers 212 as shown in FIG. 2.

The analog-digital converter 211 may be implemented using, for example, two AK4375 chips sold by ASAHI KASEI Corporation. While the analog module 210 operates in the differential mode, the digital L channel signal is provided to a first input terminal of a first AK4375 chip, and a polarity reversed signal that corresponds to the digital L channel signal is provided to a second input terminal thereof. In addition, the digital R channel signal is provided to a first input terminal of a second AK4375 chip, and a polarity reversed signal that corresponds to the digital R channel signal is provided to a second input terminal thereof. While the analog module 210 operates in the single-ended mode, the digital L channel signal is provided to the first and second input terminals of the first AK4375 chip, and the digital R channel signal is provided to the first and second input terminals of the second AK4375 chip. In some embodiments, the analog module 210 includes a first exclusive or (XOR) gate for conditionally reversing polarity of the digital L channel signal. For example, the digital L channel signal is provided to the first input terminal of the first AK4375 chip and also provided to the first XOR gate as a first input of the first XOR gate, which also receives the control signal Ctrl as a second input. An output of the first XOR gate is provided to the second input terminal of the first AK4375 chip. In some embodiments, the analog module 210 includes a second exclusive or (XOR) gate for conditionally reversing polarity of the digital R channel signal. For example, the digital R channel signal is provided to the first input terminal of the second AK4375 chip and also provided to the second XOR gate as a first input of the second XOR gate, which also receives the control signal Ctrl as a second input. An output of the second XOR gate is provided to the second input terminal of the second AK4375 chip. The XOR gates are not shown in FIG. 2 so as not to obfuscate the content of FIG. 2.

The first output port 220 includes first to fifth conductors C1 to C5. The first and second analog L signals L1 and L2, the first and second analog R signals R1 and R2, and a ground voltage GND are applied to the first to fifth conductors C1 to C5, respectively (e.g., the first analog L signal L1 is provided to the first conductor C1, the second analog L signal L2 is provided to the second conductor C2, the first analog R signal R1 is provided to the third conductor C3, the second analog R signal R2 is provided to the fourth conductor C4, and the ground voltage GND is provided to the fifth conductor C5). When a first audio jack 250 including three terminals 251 is inserted into the first output port 220, the first and second conductors C1 and C2 are connected to a first terminal that is any one of the three terminals 251, the third and fourth conductors C3 and C4 are connected to a second terminal that is another one of the three terminals 251, and the fifth conductor C5 is connected to a third terminal that is the remaining one of the three terminals 251. When the first audio jack 250 is inserted into the first output port 220, the first conductor C1 is directly connected to the first terminal without passing through another conductor (e.g., the second conductor C2), the second conductor C2 is directly connected to the first terminal without passing through another conductor (e.g., the first conductor C1), the third conductor C3 is directly connected to the second without passing through another conductor (e.g., the fourth conductor C4), and the fourth conductor C4 is directly connected to the second terminal without passing through another conductor (e.g., the third conductor C3). The first audio jack 250 may have an additional terminal (e.g., a microphone terminal, not shown) and the first output port 220 may also have an additional conductor (not shown).

The second output port 230 includes sixth to ninth conductors C6 to C9. The first and second analog L signals L1 and L2 and the first and second analog R signals R1 and R2 are applied to the sixth to ninth conductors C6, respectively. When a second audio jack 260 including four terminals 261 to 264 is inserted into the second output port 230, the sixth to ninth conductors C6 to C9 are connected to the four terminals 261 to 264, respectively. In FIG. 2, although the four terminals 261 to 264 are implemented in the form of four metal bars (or pins), the four terminals may each be implemented on a single jack (e.g., cylindrical metal conductors at different x-axis positions) as shown with respect to the first audio jack 250.

The control unit 240 detects whether the first audio jack 250 is inserted into the first output port 220, and outputs the control signal Ctrl corresponding to the detected information. When the first audio jack 250 is inserted into the first output port 220, the control unit 240 controls the analog module 210 so that the first and second analog L signals L1 and L2 and the first and second analog R signals R1 and R2 are operated in the single-ended mode. In addition, during at least a portion of a time during which the first audio jack 250 is not inserted into the first output port 220, the control unit 240 controls the analog module 210 so that the first and second analog L signals L1 and L2 and the first and second analog R signals R1 and R2 are operated in the differential mode.

The first audio jack 250 is an audio jack configured to receive single-ended L signals, single-ended R signals, and the ground voltage GND through the three terminals 251. The second audio jack 260 is an audio jack configured to receive differential L signals through the first and second terminals 261 and 262 and receive differential R signals through the third and fourth terminals 263 and 264.

When the first audio jack 250 is inserted into the first output port 220, the analog module 210 outputs the two single-ended analog L signals L1 and L2 and the two single-ended analog R signals R1 and R2. The two single-ended analog L signals L1 and L2 are applied to the first terminal of the first audio jack 250 through the first and second conductors C1 and C2 of the first output port 220. In addition, the two single-ended analog R signals R1 and R2 are applied to the second terminal of the first audio jack 250 through the third and fourth conductors C3 and C4 of the first output port 220.

During at least a portion of the time during which the first audio jack 250 is not inserted into the first output port 220, the analog module 210 outputs differential analog L signals L1 and L2 and differential analog R signals R1 and R2. The differential analog L signals L1 and L2 and the differential analog R signals R1 and R2 are applied to the first to fourth terminals 261 to 264 of the second audio jack 260 through the sixth to ninth conductors C6 to C9 of the second output port 230. At this time, the differential analog L signals L1 and L2 are even applied to the first and second conductors C1 and C2 of the first output port 220, but the first and second conductor C1 and C2 are not electrically connected and there is no power consumption in the first and second conductors C1 and C2. In addition, the differential analog R signals R1 and R2 are applied to the third and fourth conductors C3 and C4 of the first output port 220, but the third and fourth conductors C3 and C4 are not electrically connected to each other and there is no power consumption in the third and fourth conductors C3 and C4.

When the first audio jack 250 is inserted into the first output port 220 and the second audio jack 260 is inserted into the second output port 230, the analog module 210 outputs the two single-ended analog L signals L1 and L2 and the two single-ended R signals R1 and R2. The two single-ended analog L signals L1 and L2 are input to the first terminal of the first audio jack 250 and the two single-ended R signals R1 and R2 are input to the second terminal of the first audio jack 250, and the first audio jack 250 operates normally. In addition, the two single-ended analog L signals L1 and L2 are respectively input to the first and second terminal 261 and 262 of the second audio jack 260, and the two single-ended analog R signals R1 and R2 are respectively input to the third and fourth terminals 263 and 264 of the second audio jack 260. Since the two single-ended analog L signals L1 and L2 are substantially the same signal, no current flows between the first and second terminals 261 and 262 of the second audio jack 260 and unnecessary current consumption may be prevented. In addition, since the two single-ended analog R signals R1 and R2 are substantially the same signal, no current flows between the third and fourth terminals 263 and 264 of the second audio jack 260 and unnecessary current consumption may be prevented.

In the audio apparatus shown in FIG. 2, no analog switch is connected between output terminals of the amplifier 212 and the first to fourth and sixth to ninth conductors C1 to C4 and C6 to C9. Therefore, the audio apparatus shown in FIG. 2 improves sound quality by reducing or preventing sound quality degradation associated with analog switches.

In addition, when the first audio jack 250 is connected to the first output port 220, the first and second analog L signals L1 and L2 are applied to the first terminal of the first audio jack 250 and the first and second analog R signals R1 and R2 are applied to the second terminal of the first audio jack 250. Accordingly, the audio apparatus shown in FIG. 2 is capable of supplying double the drive current to the first and second terminals of the first audio jack 250 in comparison to the audio apparatus shown in FIG. 1.

Figure 3:
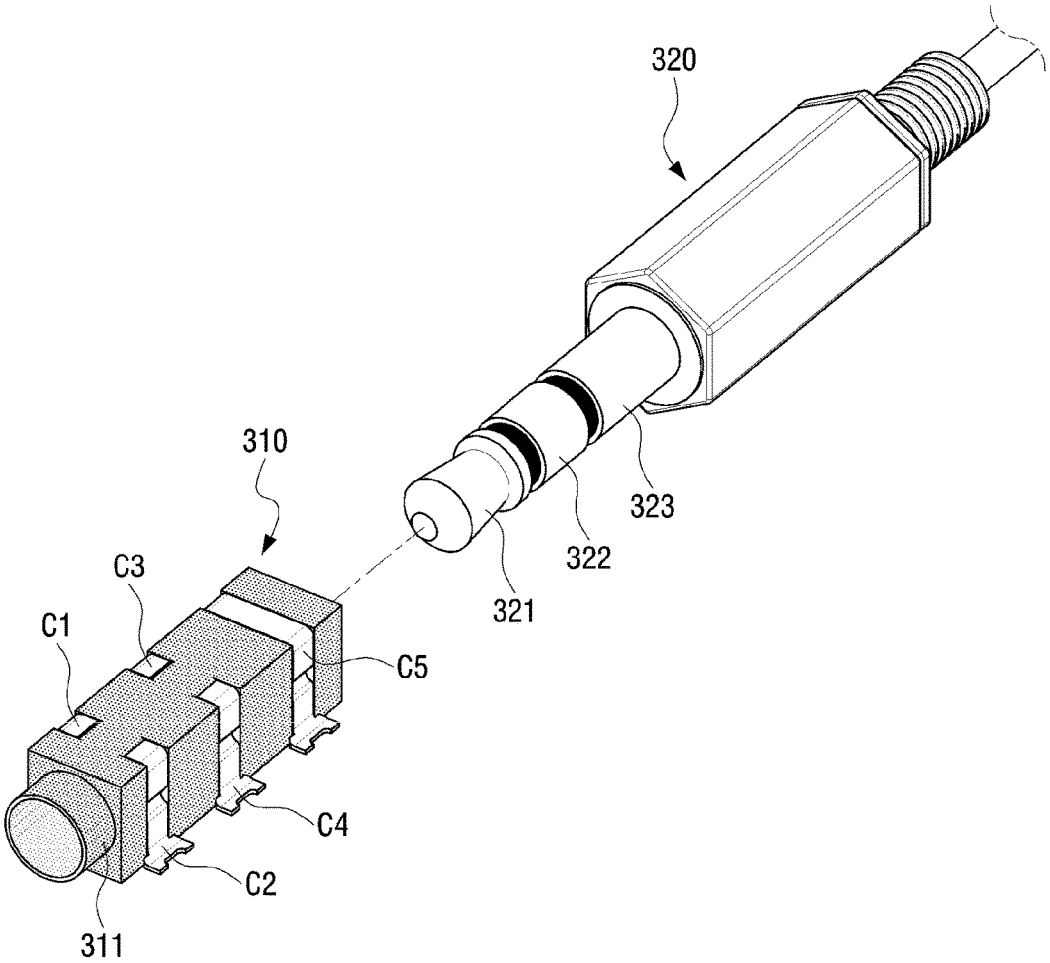
FIG. 3 is a view showing an example of an audio output port (310) applicable to a first output port (220) of the audio apparatus according to some embodiments.

FIG. 3 is a view showing an example of an audio output port 310 applicable to the first output port 220 of the audio apparatus according to some embodiments. In FIG. 3, the audio output port includes a housing 311 and first to fifth conductors C1 to C5 (which are, in some cases, mechanically coupled with the housing 311).

The first and second conductors C1 and C2 are positioned to have the same coordinate in an x-axis direction (e.g., a length-wise direction defined by the housing 411 and/or an audio jack 420), and the third and fourth conductors C3 and C4 are positioned on the same coordinate in the x-axis direction. The first and second conductors C1 and C2 are not electrically connected to each other. The third and fourth conductors C3 and C4 are not electrically connected to each other. Each of the first to fifth conductors C1 to C5 has a recessed portion inside the housing 311 (e.g., the first to fifth conductors C1 to C5 protrude internally, such as toward a center of an axis defined by a socket of the audio output port 310), and the recessed (or internally protruding) portion is brought into contact with an audio jack 320.

When the audio jack 320 is inserted into the audio output port 310, the first conductor C1 is brought into direct contact with a first terminal 321 without passing through another conductor (e.g., the second conductor C2), the second conductor C2 is brought into direct contact with the first terminal 321 without passing through another conductor (e.g., the first conductor C1), the third conductor C3 is brought into direct contact with a second terminal 322 without passing through another conductor (e.g., the fourth conductor C4), the fourth conductor C4 is brought into direct contact with the second terminal 322 without passing through another conductor (e.g., the third conductor C3), and the fifth conductor C5 is brought into contact with a third terminal 323.

When the audio jack 320 is inserted into the audio output port 310, two single-ended analog L signals are applied to the first and second conductors C1 and C2, two single-ended analog R signals are applied to the third and fourth conductors C3 and C4, and a ground voltage is applied to the fifth conductor C5.

During at least a portion of a time during which the audio jack 320 is not inserted into the audio output port 310, differential analog L signals are applied to the first and second conductors C1 and C2, differential analog R signals are applied to the third and fourth conductors C3 and C4, and the ground voltage is applied to the fifth conductor C5.

Figure 4:
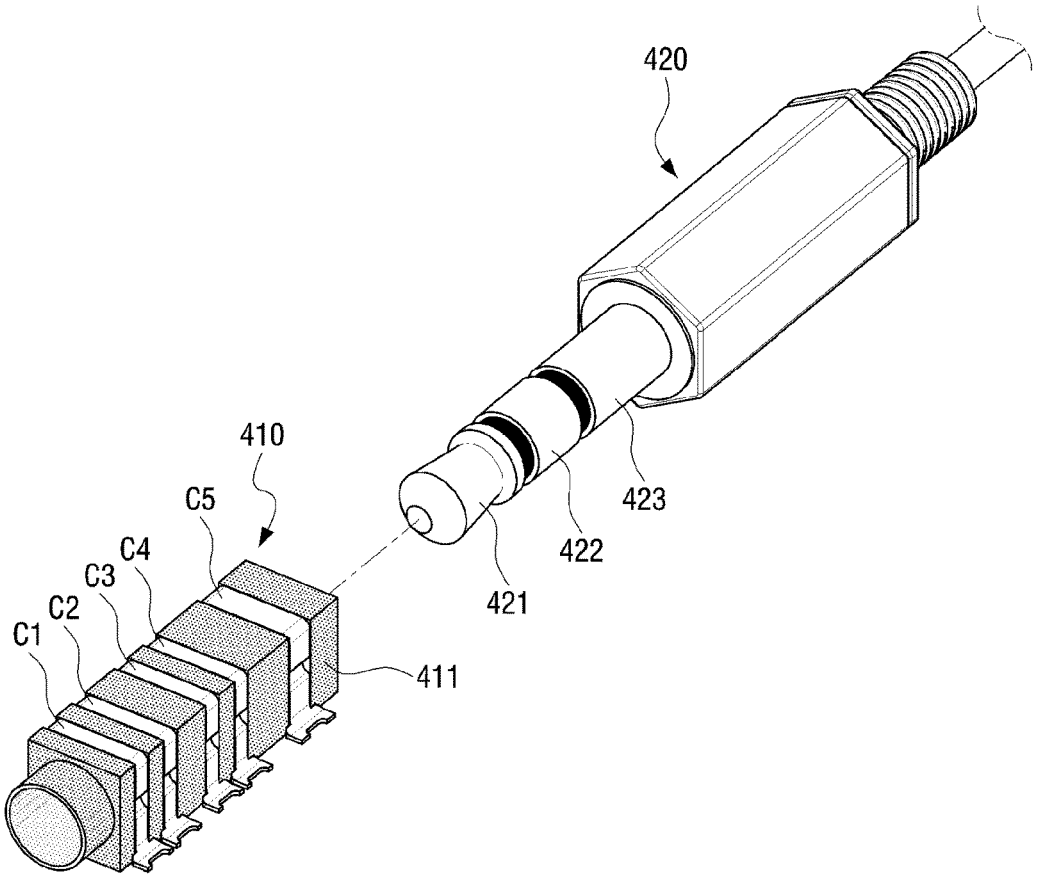
FIG. 4 is a view showing another example of an audio output port (410) applicable to the first output port (220) of the audio apparatus according to some embodiments.

FIG. 4 is a view showing another example of an audio output port 410 applicable to the first output port 220 of the audio apparatus according to some embodiments. In FIG. 4, the audio output port includes a housing 411, and first to fifth conductors C1 to C5 (which are, in some cases, mechanically coupled with the housing 411).

The first and second conductors C1 and C2 are positioned to have different coordinates in an x-axis direction (e.g., a length-wise direction defined by the housing 411 and/or an audio jack 420), and the third and fourth conductors C3 and C4 are positioned on different coordinates in the x-axis direction. In FIG. 4, the first and second conductors C1 and C2 are not electrically connected to each other, and the third and fourth conductors C3 and C4 are not electrically connected to each other. In some embodiments, each of the first to fifth conductors C1 to C5 has a recessed portion inside the housing 411 (e.g., the first to fifth conductors C1 to C5 protrude toward a center of an axis defined by a socket of the audio output port 410), and the recessed (or internally protruding) portion is brought into contact with the audio jack 420.

When the audio jack 420 is inserted into the audio output port 410, the first conductor C1 is brought into direct contact with a first terminal 421 without passing through another conductor (e.g., the second conductor C2), the second conductor C2 is brought into direct contact with the first terminal 421 without passing through another conductor (e.g., the first conductor C1), the third conductor C3 is brought into direct contact with a second terminal 422 without passing through another conductor (e.g., the fourth conductor C4), the fourth conductor C4 is brought into direct contact with the second terminal 422 without passing through another conductor (e.g., the third conductor C3), and the fifth conductor C5 is brought into contact with a third terminal 423.

When the audio jack 420 is inserted into the audio output port 410, two single-ended analog L signals are applied to the first and second conductors C1 and C2, two single-ended analog R signals are applied to the third and fourth conductors C3 and C4, and a ground voltage is applied to the fifth conductor C5.

During at least a portion of a time during which the audio jack 420 is not inserted into the audio output port 410, differential analog L signals are applied to the first and second conductors C1 and C2, differential analog R signals are applied to the third and fourth conductors C3 and C4, and the ground voltage is applied to the fifth conductor C5.

Figure 5:
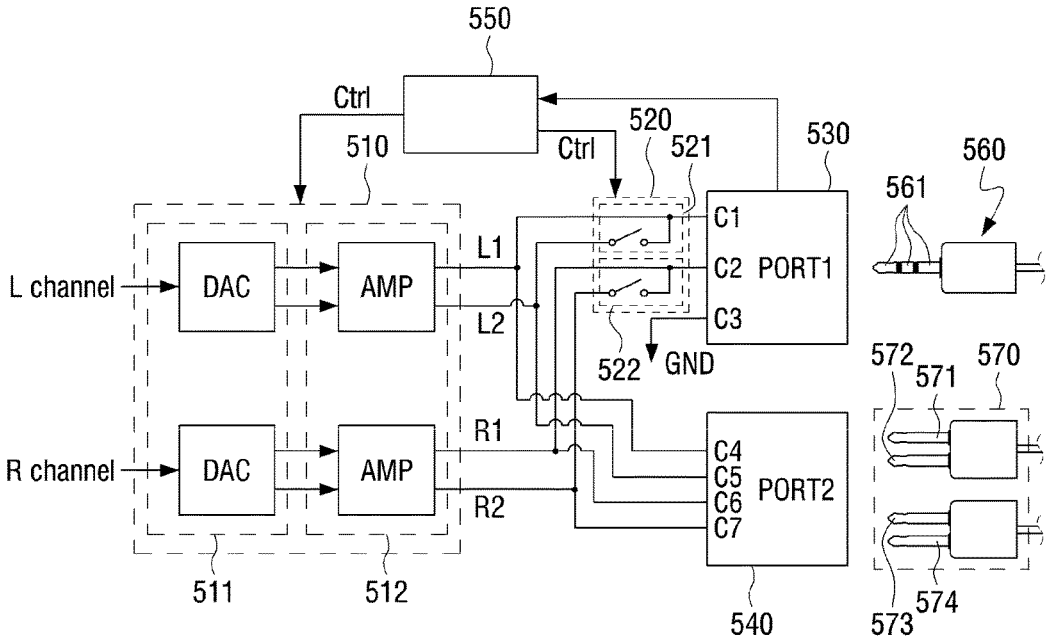
FIG. 5 is a view showing an audio apparatus according to some embodiments.

FIG. 5 is a view showing an audio apparatus according to some embodiments. In FIG. 5, the audio apparatus includes an analog module 510, an analog switch 520, a first output port 530, a second output port 540, and a control unit 550.

The analog module 510 receives a digital L channel signal and a digital R channel signal and outputs first and second analog L signals L1 and L2 and first and second analog R signals R1 and R2. The analog module 510 outputs the first and second analog L signals L1 and L2 obtained by digital-analog converting and optionally amplifying the digital L channel signal, and outputs the first and second analog R signals R1 and R2 obtained by digital-analog converting and optionally amplifying the digital R channel signal. The first and second analog L signals L1 and L2 and the first and second analog R signals R1 and R2 are output to first to fourth wires.

The analog module 510 operates in a differential mode or a single-ended mode according to a control signal Ctrl. When the analog module 510 operates in the differential mode, the analog module 510 outputs the first and second analog L signals L1 and L2 operating in the differential mode and the first and second analog R signals R1 and R2 operating in the differential mode. When the analog module 510 operates in the single-ended mode, the analog module 510 outputs the first and second analog L signals L1 and L2 operating in the single-ended mode and the first and second analog R signals R1 and R2 operating in the single-ended mode.

The analog module 510 includes a digital-analog converter 511 and optionally, an amplifier 512. The digital-analog converter 511 performs digital-analog conversion on the digital L channel signal and the digital R channel signal. The amplifier 512 outputs the first and second analog L signals L1 and L2 and the first and second analog R signals R1 and R2 obtained by amplifying the output of the digital-analog converter 511. In some embodiments, the analog module 510 includes two digital-analog converters 511 and optionally, two amplifiers 512.

The analog-digital converter 511 may be implemented using, for example, two AK4375 chips sold by ASAHI KASEI Corporation. When the analog module 510 operates in the differential mode, a digital L channel signal is provided to a first input terminal of a first AK4375 chip, and a polarity reversed signal that corresponds to the digital L channel signal is provided to a second input terminal thereof. In addition, a digital R channel signal is provided to a first input terminal of a second AK4375 chip, and a polarity reversed signal that corresponds to the digital R channel signal is provided to a second input terminal thereof. When the analog module 510 operates in the single-ended mode, the digital L channel signal is input to the first and second input terminals of the first AK4375 chip, and the digital R channel signal is input to the first and second input terminals of the second AK4375 chip.

The analog switch 520 includes a first switch 521 and a second switch 522. The first wire to which the first analog L signal L1 is applied is connected directly to a first conductor C1 (e.g., without a switch). The second wire to which the second analog L signal L2 is applied is (conditionally) connected to the first conductor C1 via the first switch 521. The third wire to which the first analog R signal R1 is applied is connected directly to a second conductor C2 (e.g., without a switch). The fourth wire to which the second analog R signal R2 is applied is (conditionally) connected to the second conductor C2 via the second switch 522. The first switch 521 connects the second wire to the first conductor C1 or disconnects the second wire from the first conductor C1 according to the control signal Ctrl. The second switch 522 connects the fourth wire to the second conductor C2 or disconnects the fourth wire from the second conductor C2 according to the control signal Ctrl.

The first output port 530 includes first to third conductors C1 to C3. According to the operation of the first switch 521, the first and second analog L signals L1 and L2 are applied to the first conductor C1 or at least one of the first and second analog L signals L1 and L2 is disconnected from the first conductor C1. According to the operation of the second switch 522, the first and second analog R signals R1 and R2 are applied to the second conductor C2 or at least one of the first and second analog R signals R1 and R2 is disconnected from the second conductor C2. A ground voltage GND is applied to the third conductor C3. When a first audio jack 560 including three terminals 561 is inserted into the first output port 530, the first conductor C1 is connected to a first terminal that is any one of the three terminals 561, the second conductor C2 is connected to a second terminal that is another one of the three terminals 561, and the third conductor C3 is connected to a third terminal that is the remaining one of the three terminals 561. The first audio jack 560 may have an additional terminal (e.g., a microphone terminal, not shown) and the first output port 530 may also have an additional conductor (not shown).

The second output port 540 includes fourth to seventh conductors C4 to C7. The first and second analog L signals L1 and L2 and the first and second analog R signals R1 and R2 are applied to the fourth to seventh conductors C4 to C7, respectively. When a second audio jack 570 including four terminals 571 to 574 is inserted into the second output port 540, the fourth to seventh conductors C4 to C7 are connected to the four terminals 571 to 574, respectively. In FIG. 5, although the four terminals 571 to 574 are implemented in the form of four metal bars (or pins), the four terminals may each be implemented on a single jack (e.g., cylindrical metal conductors at different x-axis positions) as shown with respect to the first audio jack 560.

The control unit 550 generates the control signal Ctrl according to at least one of whether the first audio jack 560 is inserted into the first output port 530 and/or whether the second audio jack 570 is inserted into the second output port 540. As an example, when the first audio jack 560 is inserted into the first output port 530, the control unit 550 controls the analog module 510 and the analog switch 520 to operate in the single-ended mode, and during at least a portion of the time during which the first audio jack 560 is not inserted into the first output port 530, the control unit 550 controls the analog module 510 and the analog switch 520 to operate in the differential mode. As another example, when the second audio jack 570 is inserted into the second output port 540, the control unit 550 control the analog module 510 and the analog switch 520 to operate in the differential mode, and during at least a portion of the time during which the second audio jack 570 is not inserted into the second output port 540, the control unit 550 controls the analog module 510 and the analog switch 520 to operate in the single-ended mode. When operating in the single-ended mode, the analog module 510 outputs first and second analog L signals L1 and L2 operating in the single-ended mode and first and second analog R signals R1 and R2 operating in the single-ended mode. In addition, when the analog switch 520 operates in the single-ended mode, the first switch 521 connects both the first and second wires to the first conductor C1, and the second switch 522 connects both the third and fourth wires to the second conductor C2. When operating in the differential mode, the analog module 510 outputs first and second analog L signals L1 and L2 operating in the differential mode and first and second analog R signals R1 and R2 operating in the differential mode. In addition, when the analog switch 520 operates in the differential mode, the first switch 521 disconnects at least any one of the first and second wires from the first conductor C1 and the second switch 522 disconnects at least any one of the third and fourth wires from the second conductor C2.

The first audio jack 560 is an audio jack configured to receive single-ended L signals, single-ended R signals, and the ground voltage GND through the three terminals 561.

The second audio jack 570 is an audio jack configured to receive differential L signals through the first and second terminals 571 and 572 and receive differential R signals through the third and fourth terminals 573 and 574.

When operating in the single-ended mode, the analog module 510 outputs two single-ended analog L signals L1 and L2 and two single-ended analog R signals R1 and R2. Both of the two single-ended analog L signals L1 and L2 are applied to the first terminal of the first audio jack 560 through the first switch 521 and the first conductor C1 of the first output port 530. In addition, both of the two single-ended analog R signals R1 and R2 are applied to the second terminal of the first audio jack 560 through the second switch 522 and the second conductor C2 of the first output port 530.

When operating in the single-ended mode, the two single-ended analog L signals L1 and L2 and the two single-ended analog R signals R1 and R2 are applied to the fourth to seventh conductors C4 to C7 of the second output port 540, respectively. At this time, even when the second audio jack 570 is inserted into the second output port 540, the single-ended analog L signals L1 and L2 substantially identical to each other are applied to the first and second terminals 571 and 572 of the second audio jack 570 so that no current flows between the first and second terminals 571 and 572. In addition, the single-ended analog R signals R1 and R2 substantially identical to each other are applied to the third and fourth terminals 573 and 574 of the second audio jack 570 so that no current flows between the third and fourth terminals 573 and 574. Therefore, unnecessary current consumption may be prevented.

When operating in the differential mode, the analog module 510 outputs differential analog L signals L1 and L2 and differential analog R signals R1 and R2. The differential analog L signals L1 and L2 and the differential analog R signals R1 and R2 are applied to the first to fourth terminals 571 to 574 of the second audio jack 570 through the fourth to seventh conductors C4 to C7 of the second output port 540.

When the analog module 510 operates in the differential mode, at least one of the first and second wires to which the differential analog L signals L1 and L2 are applied is disconnected from the first conductor C1 of the first output port 530, and at least one of the third and fourth wires to which the differential analog R signals R1 and R2 are applied is disconnected from the second conductor C2 of the first output port 530. When the first and second wires are disconnected from the first conductor C1 of the first output port 530 and the third and fourth wires are disconnected from the second conductor C2 of the first output port 530, no current flows to the audio jack 560 even though the first audio jack 560 is inserted into the first output port 530. Therefore, unnecessary current consumption may be prevented.

As described above, in the audio apparatus shown in FIG. 5, no analog switch is connected between output terminals of the amplifier 512 and the fourth to seventh conductors C4 to C7. Therefore, the audio apparatus shown in FIG. 5 reduces or prevents sound quality degradation caused by an analog switch.

In addition, when the first audio jack 560 is connected to the first output port 530, the first and second analog L signals L1 and L2 are applied to the first terminal of the first audio jack 560 and the first and second analog R signals R1 and R2 are applied to the second terminal of the first audio jack 560. Accordingly, in some embodiments, the audio apparatus shown in FIG. 5 is configured to supply double the current to the first and second terminals of the first audio jack 560 in comparison to the audio apparatus shown in FIG. 1.

In some embodiments, the audio apparatus has fewer analog switches located between an amplifier and an output port, thereby reducing or eliminating sound quality degradation caused by a resistance component of the analog switches. In some embodiments, the audio apparatus has no analog switch located between an amplifier and an output port. In some embodiments, the audio apparatus has no analog switch located between a digital-analog converter and an output port.

In some embodiments, the audio apparatus is configured to provide a high driving current for an audio jack configured for receiving single-ended signals, thereby improving sound quality.

In light of these principles, we turn to certain embodiments.

In accordance with some embodiments, an audio apparatus includes an analog module configured to receive a digital left (L) channel signal and a digital right (R) channel signal, and output first and second analog L signals and first and second analog R signals. The audio apparatus also includes a first output port including first to fifth conductors, to which the first and second analog L signals, the first and second analog R signals, and a ground voltage are provided, respectively. In some embodiments, the second conductor is distinct and separate from the first conductor. In some embodiments, the third conductor is distinct and separate from the first conductor and the second conductor. In some embodiments, the fourth conductor is distinct and separate from the first conductor, the second conductor, and the third conductor. In some embodiments, the fifth conductor is distinct and separate from the first conductor, the second conductor, the third conductor, and the fourth conductor. The audio apparatus further includes a second output port including sixth to ninth conductors, to which the first and second analog L signals and the first and second analog R signals are provided, respectively. In some embodiments, the second output port is distinct and separate from the first output port. In some embodiments, the sixth conductor is distinct and separate from the first conductor, the second conductor, the third conductor, the fourth conductor, and the fifth conductor. In some embodiments, the seventh conductor is distinct and separate from the first conductor, the second conductor, the third conductor, the fourth conductor, the fifth conductor, the sixth conductor. In some embodiments, the eighth conductor is distinct and separate from the first conductor, the second conductor, the third conductor, the fourth conductor, the fifth conductor, the sixth conductor and the seventh conductor. In some embodiments, the ninth conductor is distinct and separate from the first conductor, the second conductor, the third conductor, the fourth conductor, the fifth conductor, the sixth conductor, the seventh conductor, and the eighth conductor. While an audio jack including first to third terminals remains inserted in the first output port, the first and second conductors remain connected to the first terminal, the third and fourth conductors remain connected to the second terminal, and the fifth conductor remains connected to the third terminal.

In some embodiments, while the audio jack remains inserted in the first output port, the first and second analog L signals and the first and second analog R signals are operated in a single-ended mode, and during at least a portion of a time during which the audio jack is not inserted into the first output port, the first and second analog L signals and the first and second analog R signals are operated in a differential mode.

In some embodiments, the analog module is configured to output first and second analog L signals obtained by digital-analog converting and amplifying the digital L channel signal, and output first and second analog R signals obtained by digital-analog converting and amplifying the digital R channel signal.

In some embodiments, the audio apparatus includes a control unit configured to detect whether the audio jack is inserted into the first output port and output a control signal corresponding to the detection. The analog module is configured to output the first and second analog L signals and the first and second analog R signals in one mode selected from a differential mode and a single-ended mode in accordance with the control signal.

In some embodiments, the analog module includes a digital-analog converter configured to the digital L channel signal and the digital R channel signal into analog signals, and an amplifier configured to outputs first and second analog L signals and first and second analog R signals obtained by amplifying the analog signals from the digital-analog converter.

In some embodiments, no switch is connected between output terminals of the amplifier and the first to fourth conductors.

In some embodiments, no switch is connected between output terminals of the amplifier and the sixth to ninth conductors.

In accordance with some embodiments, an audio output port is configured to receive an insertion of an audio jack including first to third terminals. The audio output port includes a first conductor configured to connect to the first terminal while the audio jack remains inserted in the audio output port; a second conductor configured to connect to the first terminal while the audio jack remains inserted in the audio output port; a third conductor configured to connect to the second terminal while the audio jack remains inserted in the audio output port; a fourth conductor configured to connect to the second terminal while the audio jack remains inserted in the audio output port; and a fifth conductor configured to connect to the third terminal while the audio jack remains inserted in the audio output port.

In some embodiments, first and second analog left (L) signals are applied to the first and second conductors, first and second analog right (R) signals are applied to the third and fourth conductors, and a ground voltage is applied to the fifth conductor.

In some embodiments, the first and second analog L signals and the first and second analog R signals operate in a single-ended mode while the audio jack remains inserted in the audio output port, and the first and second analog L signals and the first and second analog R signals operate in a differential mode during at least a portion of a time during which the audio jack is not inserted into the audio output port.

In accordance with some embodiments, an audio apparatus includes a first output port configured to receive an insertion of a first audio jack configured for receiving a single-ended left (L) signal, a single-ended right (R) signal, and a ground voltage; a second output port configured to receive an insertion of a second audio jack configured for receiving first and second differential L signals and first and second differential R signals; a control unit configured to generate a control signal in accordance with at least one of whether the first audio jack is inserted into the first output port and whether the second audio jack is inserted into the second output port; and an analog module configured to output signals selected, in accordance with the control signal, from (a-i) differential analog L signals and (a-ii) two single-ended analog L signals, by digital-analog converting and amplifying a digital L channel signal, and output signals selected, in accordance with the control signal, from (b-i) differential analog R signals and (b-ii) two single-ended analog R signals, by digital-analog converting and amplifying a digital R channel signal.

In some embodiments, the analog module is configured to, while the first audio jack remains inserted in the first output port, output the two single-ended analog L signals and the two single-ended analog R signals, so that the two single-ended analog L signals are applied to a first terminal of the first audio jack through the first output port, and the two single-ended analog R signals are applied to a second terminal of the first audio jack through the first output port.

In some embodiments, the analog module is configured to, during at least a portion of a time during which the first audio jack is not inserted into the first output port, output the differential analog L signals and the differential analog R signals.

In some embodiments, the analog module is configured to, while the second audio jack remains inserted in the second output port, output the differential analog L signals and the differential analog R signals so that the differential analog L signals are applied to first and second terminals of the second audio jack through the second output port, and the differential analog R signals are applied to third and fourth terminals of the second audio jack through the second output port.

In some embodiments, the analog module is configured to, during at least a portion of a time during which the second audio jack is not inserted into the second output port, output the two single-ended analog L signals and the two single-ended analog R signals.

In some embodiments, the analog module is configured to output the signals selected, in accordance with the control signal, from the differential analog L signals and the two single-ended analog L signals, through first and second wires; and output the signals selected, in accordance with the control signal, from the differential analog R signals and the two single-ended analog R signals, through third and fourth wires.

In some embodiments, the first output port has first to third conductors. The second output port has fourth to seventh conductors. The first and second wires are connected to the first conductor via a first switch controlled by the control signal. The third and fourth wires are connected to the second conductor via a second switch controlled by the control signal. The first to fourth wires are connected to the fourth to seventh conductors, respectively.

In some embodiments, while the first audio jack remains inserted in the first output port, the first and second switches are controlled so that the first and second wires are electrically connected to the first conductor and the third and fourth wires are connected to the second conductor, and during at least a portion of a time during which the first audio jack is not inserted into the first output port, the first and second switches are controlled so that at least any one of the first and second wires is not electrically connected to the first conductor and at least any one of the third and fourth wires is not connected to the second conductor.

In some embodiments, while the second audio jack remains inserted in the second output port, the first and second switches are controlled so that at least any one of the first and second wires is not electrically connected to the first conductor and at least any one of the third and fourth wires is not electrically connected to the second conductor, and during at least a portion of a time during which the second audio jack is not inserted into the second output port, the first and second switches are controlled so that the first and second wires are electrically connected to the first conductor and the third and fourth wires are electrically connected to the second conductor.

In some embodiments, the first output port has first to fifth conductors. The second output port has sixth to ninth conductors. The first to fourth wires are connected to the first to fourth conductors, respectively. The first to fourth wires are also connected to the sixth to ninth conductors, respectively.

In some embodiments, the first and second conductors are configured to, while the first audio jack including first to third terminals remains inserted in the first output port, connect to the first terminal. The third and fourth conductors are configured to, while the first audio jack including first to third terminals remains inserted in the first output port, connect to the second terminal. The fifth conductor is configured to, while the first audio jack including first to third terminals remains inserted in the first output port, connect to the third terminal.

In accordance with some embodiments, a method includes receiving a digital left (L) channel signal and a digital right (R) channel signal, and outputting first and second analog L signals and first and second analog R signals. A first output port includes first to fifth conductors, to which the first and second analog L signals, the first and second analog R signals, and a ground voltage are provided, respectively. A second output port includes sixth to ninth conductors, to which the first and second analog L signals and the first and second analog R signals are provided, respectively. While an audio jack including first to third terminals remains inserted in the first output port, the first and second conductors remain connected to the first terminal, the third and fourth conductors remain connected to the second terminal, and the fifth conductor remains connected to the third terminal.

In accordance with some embodiments, a method includes providing a first audio signal through a first conductor of an audio output port configured to connect to a first terminal of an audio jack while the audio jack remains inserted in the audio output port and providing a second audio signal through a second conductor of the audio output port configured to connect to the first terminal while the audio jack remains inserted in the audio output port. The method also includes providing a third audio signal through a third conductor of the audio output port configured to connect to a second terminal of the audio jack while the audio jack remains inserted in the audio output port and providing a fourth audio signal through a fourth conductor of the audio output port configured to connect to the second terminal while the audio jack remains inserted in the audio output port. The method further includes providing a ground voltage through a fifth conductor of the audio output port configured to connect to a third terminal of the audio jack while the audio jack remains inserted in the audio output port.

In accordance with some embodiments, a method includes generating a control signal in accordance with at least one of whether a first audio jack configured for receiving a single-ended left (L) signal, a single-ended right (R) signal, and a ground voltage is inserted into a first output port and whether a second audio jack configured for receiving first and second differential L signals and first and second differential R signals is inserted into a second output port. The method also includes outputting signals selected, in accordance with the control signal, from differential analog L signals and two single-ended analog L signals, by digital-analog converting and amplifying a digital L channel signal; and outputting signals selected, in accordance with the control signal, from differential analog R signals and two single-ended analog R signals, by digital-analog converting and amplifying a digital R channel signal.

It should be apparent to those skilled in the art that various modifications can be made to the above-described exemplary embodiments without departing from the spirit or scope of the invention. Thus, it is intended that the present invention covers all such modifications within the scope of the appended claims and their equivalents.

What is claimed is:

1. An audio apparatus comprising:

an analog module configured to receive a digital left (L) channel signal and a digital right (R) channel signal, and output first and second analog L signals and first and second analog R signals;

a first output port including first to fifth conductors, to which the first and second analog L signals, the first and second analog R signals, and a ground voltage are provided, respectively; and a second output port including sixth to ninth conductors, to which the first and second analog L signals and the first and second analog R signals are provided, respectively, wherein, while an audio jack including first to third terminals remains inserted in the first output port, the first and second conductors remain connected to the first terminal, the third and fourth conductors remain connected to the second terminal, and the fifth conductor remains connected to the third terminal, and wherein, while the audio jack remains inserted in the first output port, the first and second analog L signals and the first and second analog R signals are operated in a single-ended mode, and during at least a portion of a time during which the audio jack is not inserted into the first output port, the first and second analog L signals and the first and second analog R signals are operated in a differential mode.

2. An audio apparatus comprising:

an analog module configured to receive a digital left (L) channel signal and a digital right (R) channel signal, and output first and second analog L signals and first and second analog R signals;

a first output port including first to fifth conductors, to which the first and second analog L signals, the first and second analog R signals, and a ground voltage are provided, respectively; and a second output port including sixth to ninth conductors, to which the first and second analog L signals and the first and second analog R signals are provided, respectively, wherein, while an audio jack including first to third terminals remains inserted in the first output port, the first and second conductors remain connected to the first terminal, the third and fourth conductors remain connected to the second terminal, and the fifth conductor remains connected to the third terminal, wherein the analog module is configured to output the first and second analog L signals obtained by digital-analog converting and amplifying the digital L channel signal, and output the first and second analog R signals obtained by digital-analog converting and amplifying the digital R channel signal, wherein the audio apparatus further comprises:

a control unit configured to detect whether the audio jack is inserted into the first output port and output a control signal corresponding to the detection, wherein the analog module is configured to output the first and second analog L signals and the first and second analog R signals in one mode selected from a differential mode and a single-ended mode in accordance with the control signal.

3. An audio apparatus comprising:

an analog module configured to receive a digital left (L) channel signal and a digital right (R) channel signal, and output first and second analog L signals and first and second analog R signals;

a first output port including first to fifth conductors, to which the first and second analog L signals, the first and second analog R signals, and a ground voltage are provided, respectively; and a second output port including sixth to ninth conductors, to which the first and second analog L signals and the first and second analog R signals are provided, respectively, wherein, while an audio jack including first to third terminals remains inserted in the first output port, the first and second conductors remain connected to the first terminal, the third and fourth conductors remain connected to the second terminal, and the fifth conductor remains connected to the third terminal, wherein the analog module includes a digital-analog converter configured to the digital L channel signal and the digital R channel signal into analog signals, and an amplifier configured to output the first and second analog L signals and the first and second analog R signals obtained by amplifying the analog signals from the digital-analog converter, and wherein output terminals of the amplifier satisfy at least one of the following:

no switch is connected between the output terminals of the amplifier and the first to fourth conductors; or no switch is connected between the output terminals of the amplifier and the sixth to ninth conductors.

4. The audio apparatus of claim 3, wherein no switch is connected between the output terminals of the amplifier and the first to fourth conductors, and no switch is connected between the output terminals of the amplifier and the sixth to ninth conductors.

* * * * *